US007156207B2

(12) United States Patent
Simon

(10) Patent No.: US 7,156,207 B2
(45) Date of Patent: Jan. 2, 2007

(54) FOOD PRESENTATION METHOD AND SYSTEM

(75) Inventor: Tristan M. Simon, Dallas, TX (US)

(73) Assignee: Genghis Grill Franchise Concepts, L.P., Dallas, TX (US)

( * ) Notice: Subject to any disclaimer, the term of this patent is extended or adjusted under 35 U.S.C. 154(b) by 212 days.

(21) Appl. No.: 10/716,052

(22) Filed: Nov. 18, 2003

(65) Prior Publication Data

US 2005/0103572 A1 May 19, 2005

(51) Int. Cl.
*A47B 71/00* (2006.01)

(52) U.S. Cl. ..... 186/38

(58) Field of Classification Search ..... 186/38, 186/44; 426/383; 206/775; 99/448; 312/140.1, 312/234.1–5; 108/25, 26; 40/324, 637; 434/127, 433, 429

See application file for complete search history.

(56) References Cited

U.S. PATENT DOCUMENTS 1,598,849 A * 9/1926 Colby ..... 108/25
3,162,495 A * 12/1964 Swift ..... 108/23
4,689,019 A * 8/1987 Tilney ..... 434/127
4,892,366 A * 1/1990 Yerman ..... 312/140.4
4,950,164 A * 8/1990 Lennon-Thompson et al. ..... 434/127
5,335,509 A * 8/1994 Namisniak et al. ..... 62/125
6,038,546 A * 3/2000 Ferro ..... 705/15
6,279,958 B1 * 8/2001 Santa Cruz et al. ..... 283/65
6,553,386 B1 * 4/2003 Alabaster ..... 707/104.1

* cited by examiner

*Primary Examiner*—Patrick Mackey
*Assistant Examiner*—Mark J Beauchaine
(74) *Attorney, Agent, or Firm*—Conley Rose, P.C.

(57) ABSTRACT

A method and system for serving food. A plurality of sets of compatible food items are selected and a unique identifier is assigned to each set. The food items are placed in individual display containers. Each display container is marked with the one or more unique identifier(s) of sets which include the food item in the display container. A meal is prepared by selecting one of the unique identifiers and collecting a portion of each food item which is marked with the selected unique identifier. The collected portions are placed into a collection container, then cooked together and placed into a serving container and served as a meal.

32 Claims, 2 Drawing Sheets

FOOD PRESENTATION METHOD AND SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a system and method and system for presenting food and assembling a meal, and more particularly to a method and system for associating a number of displayed food items to simplify selection of compatible food items needed for preparing a meal.

BACKGROUND OF THE INVENTION

The term Mongolian barbeque may refer both to a method of preparing a hot meal and to a type of restaurant in which the method is used. The method is claimed to have originated with the army of Genghis Khan. According to legend, in the evening soldiers placed their shields over an open fire. They collected a variety of available food items, e.g. meats, vegetables, spices and oils. The soldiers reportedly placed the food items on the heated shields and stirred them as they cooked.

In contemporary Mongolian barbeque restaurants, a variety of uncooked food items are displayed on one or more food bars. Food items commonly include a selection of various meats, vegetables, noodles, rice, oils, spices, condiments etc. Each customer selects a variety of food items and places them in a collection bowl. A restaurant employee then takes the bowl and stir-fry cooks the contents on a hot grill. The cooked mixture is placed into a serving bowl and delivered to the customer as a meal.

Unfortunately, many customers do not have experience creating or cooking meals and may select various food items that are not compatible. That is, the food flavors may not complement each other or may conflict to the extent that the customer is unhappy and may not try this type of restaurant again.

SUMMARY OF THE INVENTION

A method and system for presenting food. A plurality of sets of food items are selected and a unique identifier is assigned to each set. The food items are placed in individual display containers. Each display container is marked with all the unique identifiers of sets which include the food item in the display container. A meal is assembled by selecting one of the unique identifiers and collecting a portion of each food item which is marked with the selected unique identifier.

DETAILED DESCRIPTION OF THE PREFERRED EMBODIMENTS

Figure 1:
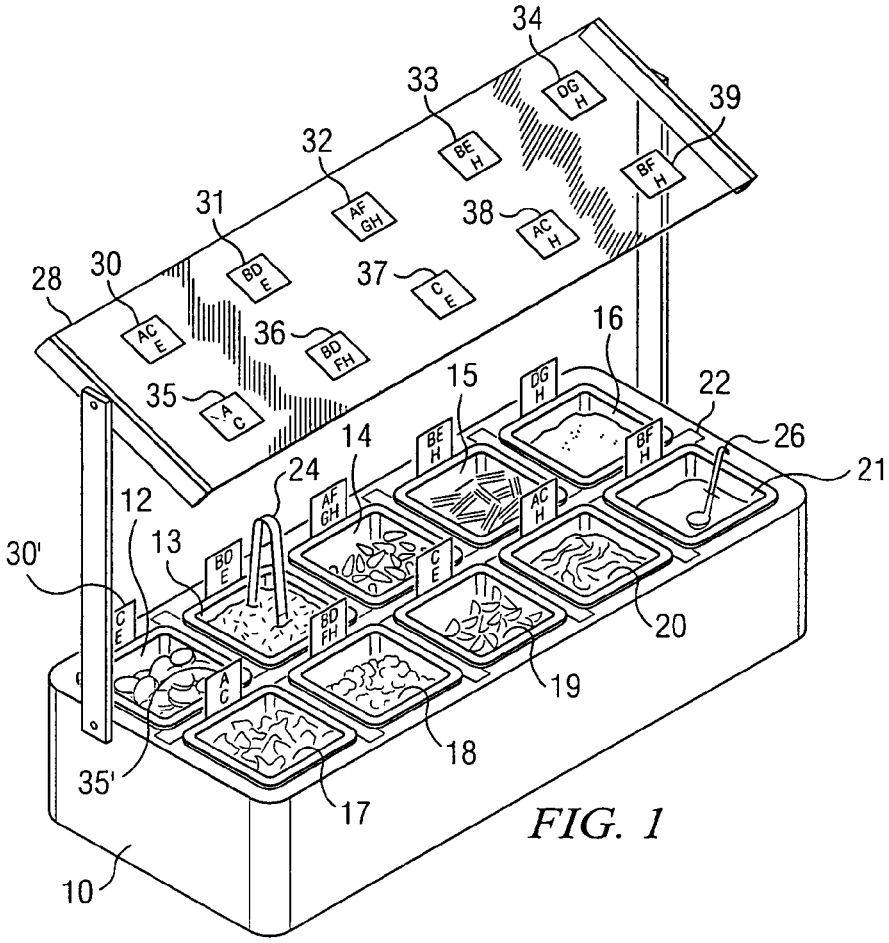
FIG. 1 is a perspective view of a food item display system including menu item identifiers associated with each food item.

With reference to FIG. 1, one embodiment of a food display portion of a food assembly and serving method and system will be described. A food display bar or counter 10 is shown holding ten food display containers 12 through 21. The counter 10 has an upper surface 22 located at a normal serving counter height. It may be supported on legs, not shown. The counter 10 may include a refrigeration unit or may have ice under and between the display containers 12–21, to keep food items fresh. In this embodiment, each display container 12–21 may be an essentially square stainless steel container. Each container 12–21 may be used to display one food item, e.g. a meat, vegetable, sauce, oil, spice, condiment, etc. Each display container 12–21 may be supplied with a pair of tongs 24, a ladle 26, or another serving utensil appropriate for removing portions of food items from each display container.

Supported above the counter 10 is a substantially transparent sneeze guard 28 as is typically used to prevent contamination of food displayed on self-service buffets or salad bars. The guard 28 may be suspended from the ceiling above the counter 10 or may be supported on the counter 10 itself. A plurality of labels 30–39 are carried on the sneeze guard 28 and positioned to be visible from the top. Since the sneeze guard 28 is transparent, the labels 30–39 may be located on the top or bottom of the guard 28. Each label 30–39 is associated with one of the food item display containers 12–21, respectively. The labels may be associated by positioning them on the sneeze guard 28 in the same relative positions as their associated display containers 12–21. For example, label 30 is positioned in the back left hand corner of the sneeze guard 28 and is thereby associated with display container 12 which is positioned in the back left hand corner of the display counter 10. As explained in detail below, each label 30–39 includes all the unique identifiers indicating in which one or more menu items the associated food item is included.

The labels 30–39 may be associated with their respective display containers 12–21 is other ways. For example, labels 30' and 35' may be attached directly to their respective associated display containers 12 and 17 as illustrated. The labels 30' and 35' may be mounted on a spring-loaded clasp or clip for gripping the edge of the display containers 12 and 17. In similar fashion, the labels 30–39 could be supported on an edge or other portion of the display counter 10. The labels may be printed directly onto a surface of the display containers 12–21, instead of being a separate detachable part. The present invention is not intended to be limited to any particular apparatus or method of associating the labels 30–39 with the food item display containers 12–21.

Each food container 12–21 contains one food item, suitable in this embodiment for inclusion in a Mongolian barbeque meal. The food counter 10 is illustrated with only ten food display containers 12-21 to simplify the drawings for purposes of this patent specification. There will typically be more than ten food items included in the display counter 10 in a Mongolian barbeque style restaurant or other type of buffet style restaurant. The counter 10 may be enlarged to contain more than ten display containers 12–21, or multiple counters 10 may be used together.

Food items which may be displayed on food counter 10 include, without limitation: seafood items such as shrimp, scallops, calamari, fish; meat items such as beef tips, brisket, pork, chicken, turkey, ham; vegetable items such as water chestnuts, green and white onions, tomatoes, mushrooms, broccoli, zucchini and other squashes, bok choy, corn, green beans, cabbage, pineapple, bamboo shoots, carrots, peanuts, jalapenos; other items such as noodles, rice, soy sauce, salt, pepper and other condiments, spices, seasonings, etc.

Figure 2:
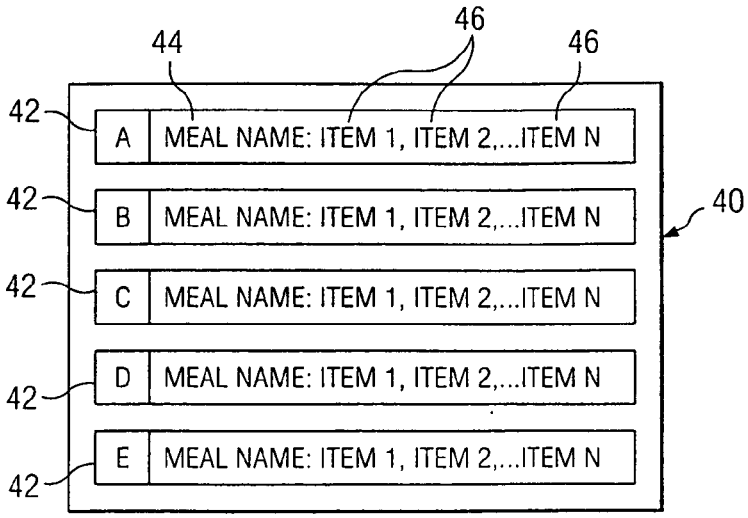
FIG. 2 is a plan view of a menu board listing a group of menu items by name and the set of food items included in each menu item and an associated identifier for each menu item.

FIG. 2 illustrates a menu board or sign 40 which may be used in the present invention. The menu board 40, in this example, contains five separate menu items, each having an unique identifier 42, in this case the letters A through E. Menu item A includes a menu item or meal name 44 and a number of food item names 46, which when combined and cooked constitute a meal. The set of food items in each meal is preferable selected by a professional food preparation expert to be compatible and complementary when combined and cooked together. In this example, the menu board 40 is shown as having only five menu items to simplify the drawings. Any number of meals may be preselected and included on the menu board 40.

Figure 3:
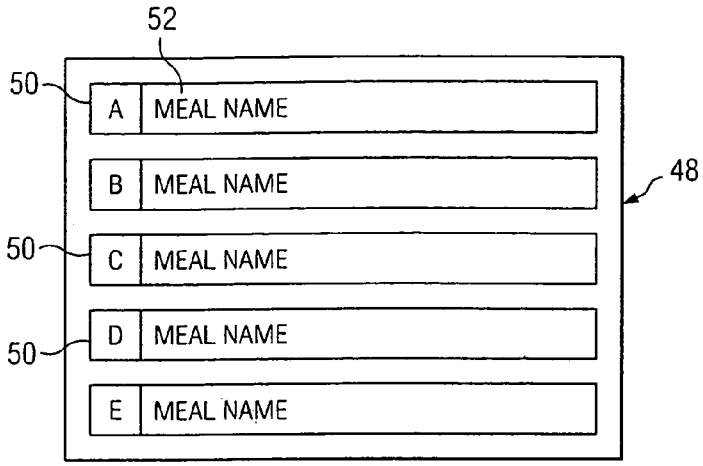
FIG. 3 is a plan view of a simplified menu board listing a group of menu items by name only and an associated identifier for each menu item.

FIG. 3 illustrates a simplified menu board or sign 48 which may also be used in the present invention. The menu board 48 includes unique identifiers 50 for a group of menu items identified only by meal names 52. That is, in this embodiment, the actual list of food items included in each menu item 52 is not provided on the sign 48. This embodiment illustrates that the present invention allows a person to assemble a meal without actually having a list of the food items included in the menu item.

As illustrated in FIGS. 2 and 3, each menu item is identified by a unique identifier 42 or 50. To simplify the drawings for this application, the letters A through E have been selected as the unique identifiers. However, other alphanumeric characters, iconographic symbols, Braille characters or colors may be used. For example, in one embodiment, the identifiers 42 and 50 are each a separate and distinct color. The color may be displayed in a separate space to the left of the meal names 44, 52 as shown in FIGS. 2 and 3. However, colors as unique identifiers may also be associated with the meal names 44, 52 in other ways, for example by displaying the meal names 44, 52 using the associated colors or by displaying each meal name 44, 52 on a background of the associated colors. In another embodiment, the color identifiers 42 and 50 will each be combined with an alphanumeric character or iconographic symbol for easier identification, especially by people with poor color vision. Iconographic symbols may be useful as indications of the nature of a menu item. For example, a representation of a pepper may be used and may suggest that the meal is spicy. An iconographic symbol may also be used in place of or in addition to a name for each menu item. In addition, it may be desirable to include a unique Braille symbol so that blind people may use the system and method disclosed herein.

Figure 4:
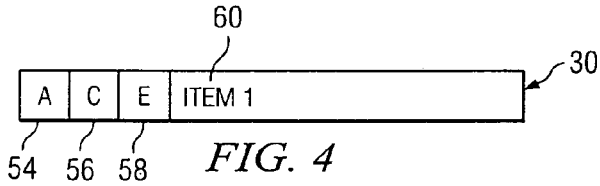
FIG. 4 is a plan view showing more details of labels used in the display system of FIG. 1.

FIG. 4 provides more detail of the labels 30–39 of FIG. 1. In this example, label 30 is shown as including three unique menu item identifiers 54, 56 and 58, with the letters A, C and E. This label therefore indicates that the food item associated with label 30 is included in each menu item identified by the letters A, C and E. As noted above, in one embodiment the identifiers 54, 56 and 58 would be colors. The label 30 may also include a name 60 of the food item displayed in the associated display container, in this case container 12. For purposes of the present invention, it is not actually necessary to know the name of the food items. However, for customers who choose to assemble a meal according to their own recipe or who wish to avoid certain food items, it may be desirable to include the names of food items on the labels 30–39. The labels 30–39 may be of any desirable shape, e.g. square as shown in FIG. 1 or rectangular as in FIG. 4, as long as the unique identifiers can be displayed.

Figure 5:
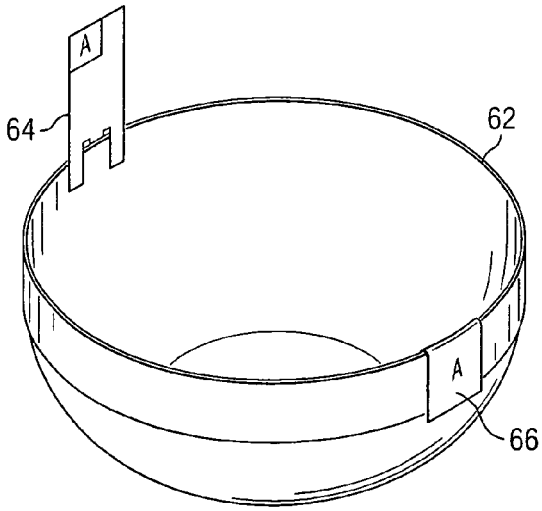
FIG. 5 is a perspective view of a food collection container with menu item identifier labels.
Figure 6:
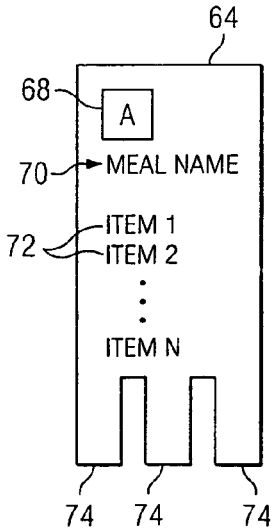
FIG. 6 is a plan view of a menu item identifier tag useful with the collection container of FIG. 5.

FIG. 5 illustrates a food collection container 62 according to one embodiment. The collection container 62 may be a simple round bowl, e.g. made of stainless steel. In this embodiment, a menu tag 64 or 66 is attached to the container 62. As illustrated in FIG. 6, the tag 64 includes a unique identifier 68, in this case the letter A. The tag 64 may in addition optionally include the menu item name 70 which is associated with the letter A. The tag 64 may as a further option contain a list of the food items 72 included in the menu item associated with the letter A. The tag 64 may include tabs 74 along a bottom edge with which the tag 64 may be clipped onto the edge of the food collection container 62 as illustrated in FIG. 5. Tag 66 in FIG. 5 may display the same information as tag 64, but may be attached to the exterior of container 62 by an adhesive backing. As noted above, the identifier 68 may be a color or an alphanumeric character or an iconographic symbol or a Braille character or a combination of these, so long as the identifier 68 uniquely identifies one of the menu item in a system according to the present invention. If the unique identifier is a color, the entire tag 64, or 66 may be of that color, with other information printed over the color background. Since the meal name and food item names is not actually necessary for practicing the present invention, the tags 64 and 66 may be simply colored tags, with no printed information.

It should be noted that the tags 64 and 66 of FIG. 5 include only one unique menu item identifier. The tags 64 and 66 need not be attached to the collection container 62 as illustrated, but may simply be a card carried by a person assembling a meal according to the present invention. Instead of separate tags 64, 66, the tag information may be printed directly onto the collection containers 62. If the unique identifiers are colors, collection containers 62 may be provided in each of the colors used as identifiers. The tags 64 and 66 are only optional, and serve primarily as a memory aid for the person who is assembling a meal.

The figures illustrate the basic elements of a system according to the present invention. The uses of these elements will now be described to illustrate various embodiments of methods which may be practiced within the scope of the present invention.

The present invention provides a simple method by which a person who is not an expert at preparing meals can assemble a plurality of food items into a high quality meal. For purposes of this disclosure, a high quality meal comprises a mixture of food items selected to be complementary and compatible with each other in terms of flavors, textures, appearance, etc. It is preferred that the selection of food items for such meals be made by trained and experienced food preparation professionals. As shown in FIG. 2, a number of such selections are preferably made. Each menu item is a set of food items, preferably complementary. Each menu item is given a unique identifier, for example a color. The menu items may be displayed as shown in FIG. 2, where each menu item is given an arbitrary name and the list of food items comprising the meal is also displayed. As shown in FIG. 3, it is not actually necessary to display the names of the food items. However, many customers may want to make a selection from the menu based on the specific food items and would want to know the included items before selecting from the menu. For example, some customers may prefer chicken over beef, or may want a vegetarian meal.

Each of the food items included in all of the menu items on the menu board 40, are then displayed in the individual food display containers 12–21 on the display counter 22. A label 30–39 is prepared for each food item in the display containers 12–21. Each label includes, as a minimum, the unique identifier, e.g. 42 in FIG. 2, for all of the menu items in which the food item in the associated display container 12–21 is included. For example, if the food item in display container 12 is chicken and chicken is included in the menu items identified by the letters A, C and E, then the label 30 associated with display container 12 will show the identifiers A, C and E. If desired, the labels 30–39 may also include the name of the food item in the associated display containers 12–21.

A person, e.g. a restaurant customer, may then review the menu board 40 and select one of the menu items. Having made a selection and taken note of the unique identifier associated with the menu item, the person need only remember the unique identifier to assemble a meal. The person may pick up a collection container, FIG. 5, and go to the display counter 22. The person may then assemble a meal by removing a portion of each food item on the counter 22 which has a label 30–39 which includes the unique identifier for the menu item the person selected. All the food items that have been placed in the collection container may then be placed onto a cooking surface, e.g. a grill, and cooked, e.g. stir-fried. After cooking, the food items may be placed in a serving container, e.g. a plate or bowl, and served as a meal. For food safety purposes, it is preferred that the food collection container not be used as the serving container.

As noted above, creation of menu items is preferably done by a food preparation professional. Stocking and labeling of the display counter 22 is normally performed by restaurant employees. A customer normally makes a selection from the menu and places the selected food items in the collection container. Primarily for safety reasons, a restaurant employee normally takes the collection container from the customer and cooks the meal on a grill. The employee then places the cooked meal into the serving container and returns it to the customer as a completed cooked meal.

The meal collection steps may be performed by a restaurant employee or by another person assisting the customer. For example, the customer may simply make the menu selection and the rest of the process could be performed in the restaurant kitchen. Likewise, it would be possible for the customer to place the collected food items on a grill and perform the cooking step without assistance.

As shown in FIGS. 5 and 6, various memory aids may be provided to assist a customer is selecting food items. A tag 64 may be provided for each meal on the menu board 40, 48. After making a menu selection, the customer may pick up the tag bearing the associated unique identifier. The customer may then carry the tag while collecting the food items from the counter 10, or may attach the tag to a food collection container as shown in FIG. 5. If desired, the tags 64 may be used in place of the menu boards 40, 48. The tags 64 may be placed in dispensers near the display counter 10 and a customer may make a menu selection be perusing the tags. In any case, a customer may carry a tag while collecting food items. Even if the tag 64 shows only the unique identifier for a menu item, the customer may accurately assemble the food items simply by comparing the tag to each of the labels on the sneeze guard 28 and taking a portion of the food item in the display containers 30–39 which are marked with the proper unique identifier. Note that this arrangement allows a person who cannot read, or cannot read the English language, to accurately assemble any of the menu items.

The present invention may also be practiced by restaurant customers who are willing to try new menu items without knowing in advance the name of the menu item or what food items are included. For example, a customer may arbitrarily select one of the unique identifiers, for example a color. The arbitrary selection could be by withdrawing a tag 64 or a colored ball, etc. from a mixture of tags 64 or other items, or by spinning a wheel which shows all of the menu board 40 unique identifiers. Then the customer may collect the food items identified by the unique identifier and prepare a meal. The customer will have the assurance that the meal is professionally created, even though the final result may be a surprise to the customer. This would avoid the unhappy experience customers may have when they arbitrarily mix food items from the display counter 22.

While the present invention has been illustrated and described with reference to particular systems and methods of operation, it is apparent that various changes and substitutions of elements or steps may be made within the scope of the present invention as defined by the appended claims.

I claim:

1. In a restaurant of the type in which a plurality of food items are displayed in individual food display containers, customers assemble meals by removing portions of food items from the display containers, and the removed portions are cooked together, a method for assembling a meal, comprising:

selecting a plurality of menu items, each menu item comprising a plurality of food items;

assigning a unique identifier to each menu item;

displaying each of the food items in an individual food item display container;

providing a label associated with each food item display container, each label comprising all unique identifiers associated with each menu item in which the food item is included;

removing portions of food items from each individual food item display container having an associated label comprising one of said unique identifiers; and, placing the portions of food items removed from each of the individual containers having an associated label comprising one of said unique identifiers in a collection container.

2. A method for assembling a meal according to claim 1, wherein each menu item comprises food items which are compatible with each other.

3. A method for assembling a meal according to claim 1, further comprising providing a menu comprising each of the unique identifiers.

4. A method for assembling a meal according to claim 3, further comprising providing on the menu the names of each food item in each set of food items in association with the unique identifier associated with each menu item.

5. A method for assembling a meal according to claim 3, further comprising providing on the menu an arbitrary name for each menu item in association with the unique identifier associated with each menu item.

6. A method for assembling a meal according to claim 3, wherein the menu comprises a menu board.

7. A method for assembling a meal according to claim 3, wherein the menu comprises a plurality of tags each comprising one of the unique identifiers.

8. A method for assembling a meal according to claim 1, further comprising attaching each label to a sneeze guard located proximate the food display containers.

9. A method for assembling a meal according to claim 1, further comprising attaching each label to a food display container.

10. A method for assembling a meal according to claim 1, further comprising cooking all the food items contained in the collection container together.

11. A method for assembling a meal according to claim 10, further comprising placing the cooked food items in a serving container.

12. A method for assembling a meal according to claim 11, further comprising serving the cooked food items in the serving container as a meal.

13. A method for assembling a meal according to claim 1, further comprising providing representations of the unique identifiers for the collection containers.

14. A method for assembling a meal according to claim 13, wherein the representations are releaseably attachable to the collection containers.

15. A method for assembling a meal according to claim 14, wherein the representations comprise an adhesive for releasable attachment to a collection container.

16. A method for assembling a meal according to claim 14, wherein the representations comprise a spring-loaded clamp for releasable attachment to a collection container.

17. A method for assembling a meal according to claim 13, wherein the representations are permanently attached to the collection containers.

18. A method for assembling a meal according to claim 1, wherein each unique identifier is a color.

19. A method for assembling a meal according to claim 1, wherein each unique identifier comprises alphanumeric characters.

20. A method for assembling a meal according to claim 1, wherein each unique identifier comprises a Braille symbol.

21. A method for assembling a meal according to claim 1, wherein each unique identifier comprises an iconographic symbol.

22. In a restaurant of the type in which a plurality of food items are provided in individual food display containers, meals are assembled by selecting portions of food items from the display containers, and the selected portions are cooked together, a method for assembling a meal comprising:

preselecting a plurality of menu items, each menu item comprising a plurality of food items;

assigning a unique identifier to each menu item;

providing a label associated with each food item display container, each label comprising all unique identifiers associated with each menu item in which the food item is included; and, placing selected portions of food items in a collection container.

23. The method for assembling a meal according to claim 22, further comprising providing a menu comprising each of the unique identifiers.

24. A method for assembling a meal according to claim 22, further comprising attaching each label to a sneeze guard located proximate the food display containers.

25. A method for assembling a meal according to claim 22, further comprising attaching each label to a food display container.

26. A method for assembling a meal according to claim 22 further comprising providing representations of the unique identifiers for collection containers.

27. In a restaurant of the type in which a plurality of food items are displayed in individual food display containers, customers assemble meals by selecting portions of food items from the display containers, and the selected portions are cooked together, a system for assembling a meal, comprising:

a plurality of menu items, each menu item comprising a plurality of food items;

a unique identifier associated with each menu item;

a plurality of display containers, each containing one of said food items;

associated with each display container, a representation of all unique identifiers associated with each menu item in which the food item in the display container is included; and a collection container for receiving food items.

28. A system for assembling a meal according to claim 27, wherein each menu item comprises food items which are compatible with each other.

29. A system for assembling a meal according to claim 27, further comprising a menu containing representations of the unique identifiers.

30. A system for assembling a meal according to claim 29, wherein the menu comprises a list of the names of each food item included in each menu item associated with the unique identifier associated with the menu item.

31. A system for assembling a meal according to claim 27, wherein the collection container comprises a representation of one of the unique identifiers.

32. A system for assembling a meal according to claim 31, wherein the representation is releasably attached to the collection container.

* * * * *